US006508349B1

(12) United States Patent
Lewin

(10) Patent No.: US 6,508,349 B1
(45) Date of Patent: Jan. 21, 2003

(54) PARKING METER WITH ELECTRIC GROUNDING ARRANGEMENT FOR CORROSION REDUCTION

(75) Inventor: Scott J. Lewin, 1565 NW. 159th Ave., Pembroke Pines, FL (US) 33028

(73) Assignees: Scott J. Lewin, Pembroke Pines, FL (US); Stanley Kotler, Hialeah, FL (US); Alan H. Kepke, Hialeah, FL (US)

( * ) Notice: Subject to any disclaimer, the term of this patent is extended or adjusted under 35 U.S.C. 154(b) by 51 days.

(21) Appl. No.: 09/790,882

(22) Filed: Feb. 23, 2001

(51) Int. Cl.[7] ..... G07F 9/10
(52) U.S. Cl. ..... 194/350; 422/7; 307/95
(58) Field of Search ..... 194/350; 422/7; 307/95; 174/6, 51

(56) References Cited

U.S. PATENT DOCUMENTS

| | | | | | |
|---|---|---|---|---|---|
| 989,596 | A | | 4/1911 | Geppert | |
| 1,055,327 | A | * | 3/1913 | Hering | 138/DIG. 6 |
| 3,391,072 | A | | 7/1968 | Pearson | 204/197 |
| 3,578,982 | A | | 5/1971 | Nelson | 307/95 |
| 4,209,889 | A | * | 7/1980 | Silva et al. | 29/432 |
| 4,544,464 | A | | 10/1985 | Bianchi et al. | 204/147 |
| 4,647,353 | A | * | 3/1987 | McCready | 106/287.23 |
| 4,798,273 | A | * | 1/1989 | Ward, II | 194/350 |
| 5,352,342 | A | | 10/1994 | Riffe | 204/147 |
| 5,366,604 | A | | 11/1994 | Stilley | 204/196 |
| 5,478,451 | A | | 12/1995 | Riffe | 204/147 |
| 5,569,526 | A | | 10/1996 | Tettamanti et al. | 428/225 |
| H1644 | H | | 5/1997 | Muehl, Sr. | 204/196 |
| 5,714,045 | A | * | 2/1998 | Lasa et al. | 204/196.18 |
| 5,759,361 | A | | 6/1998 | Bennett et al. | 204/196 |
| 6,022,469 | A | | 2/2000 | Page | 205/734 |

FOREIGN PATENT DOCUMENTS

| | | | | | |
|---|---|---|---|---|---|
| JP | 1-234580 | A | * | 9/1989 | C23F/13/00 |

* cited by examiner

*Primary Examiner*—Donald P. Walsh
*Assistant Examiner*—Mark J. Beauchaine
(74) *Attorney, Agent, or Firm*—Lowe Hauptman Gilman & Berner, LLP

(57) ABSTRACT

A parking meter includes a vault and mounting plate inside the vault. The plate and vault have contacting metal surfaces such that corrosion tends to occur in a region at and in the vicinity of the contacting metal surfaces in response to electrolysis induced electric current having a tendency to flow between the contacting metal surfaces. A spider attachment bolt passing through openings in a base of the vault is threaded to a bore in the mounting plate and a spider having legs engaging the interior wall of a hollow pole connecting the vault to a concrete structure in the ground so the vault is secured to the pole. A metal structure electrically and mechanically connected to the region and inserted into the earth in the vicinity of the parking meter shunts to the earth the current having a tendency to flow between the contacting metal surfaces. The metal structure includes an aluminum rod extending through the pole portion below the spider and the concrete to the ground, an aluminum plate contacting the mounting plate and an aluminum wire extending between adjacent legs of the spider and connected between the aluminum plate and the aluminum plate.

14 Claims, 2 Drawing Sheets

FIG. 4
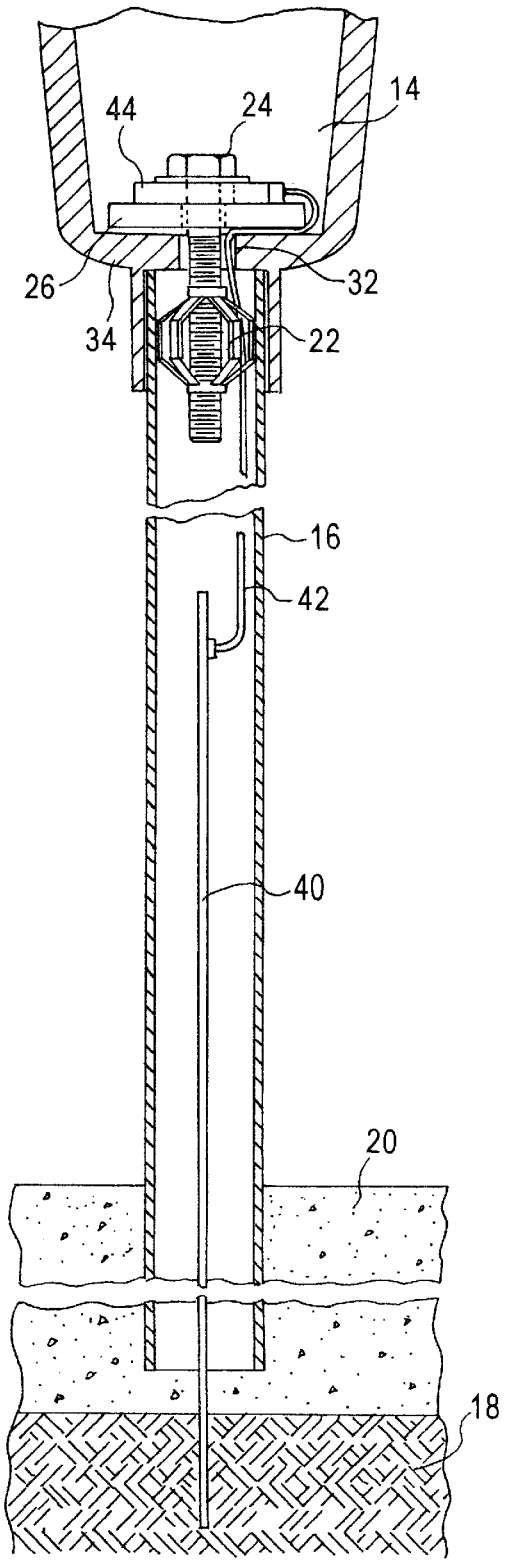
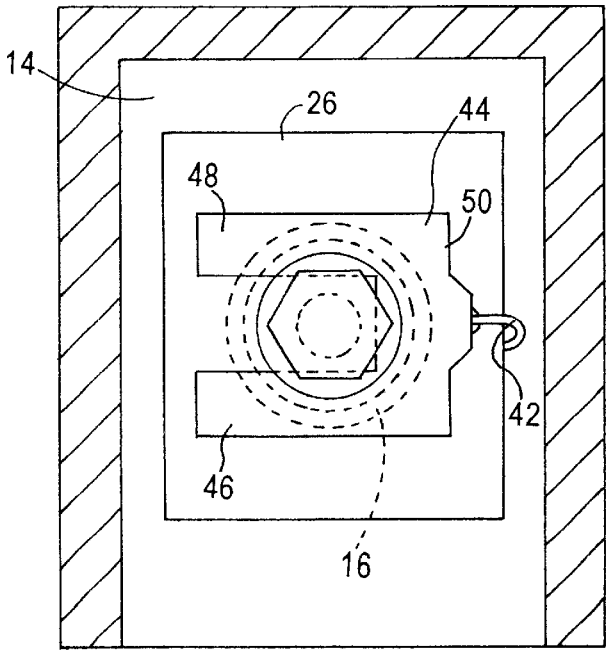
FIG. 5
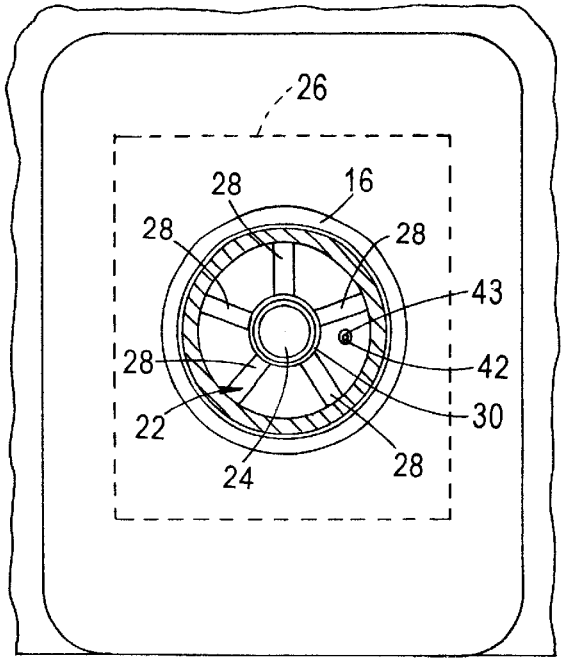
FIG. 6

PARKING METER WITH ELECTRIC GROUNDING ARRANGEMENT FOR CORROSION REDUCTION

FIELD OF THE INVENTION

The present relates generally to parking meters and, more particularly, to a parking meter with a grounding arrangement for reducing corrosion effects due to electrolysis.

Background Art

A typical parking meter includes a housing for a meter operating mechanism, i.e., a meter head, connected to a vault for receiving coins and/or credit cards and/or debit cards. The vault is secured to the top of a hollow pole having a lower end usually embedded in a concrete structure, e.g., a footing or a concrete sidewalk. The vault is secured to the pole by a spider having radially extending legs bearing against an interior wall of the pole. A steel bolt is threaded into a central opening of the spider and extends through a hole in a base at the bottom of the vault. A steel mounting plate having a central, threaded bore secures the bolt to an interior face of the base of the vault. The bolt, mounting plate and spider secure the vault to the pole. In some meters, the vault and head are made of cast iron. In other meters, the vault and housing are made of cast Zamac, an alloy of zinc and aluminum. The head and vault are usually made of the same materials but some are made of a combination of cast iron and cast Zamac, such that, in some meters the vault is made of cast iron and the head is made of cast Zamac, and in other meters the vault is made of cast Zamac and the head is cast iron.

To enhance the life and appearance of the vault and housing, the cast iron vault and housing can be covered with hot dipped galvanized steel coatings, in turn covered by non-epoxy thermosetting electrically insulating organic powder coatings, as disclosed in my co-pending, commonly assigned application, Ser. No. 08/841,724, filed Apr. 24, 1997, entitled "Housing for Parking Meters and Other Outdoor Token Handling Devices and Method of Making Same."

In actual field tests of cast iron parking meters having such hot dipped galvanized and organic powder coatings and of Zamac meters, it was found that corrosion originated at the intersection of the vault and the steel mounting plate and spread to the head and pole. I have determined that the corrosive effects, which are the greatest when the parking meters are in salt water laden air, as at the seashore, and/or in meters having dissimilar metals at the contacting surfaces of the mounting plate and vault base, are due to electric current flowing in response to an electrolysis effect between the contacting metal surfaces. The electrolysis effect is due to salt water ions penetrating the vault and/or the effects of the electrochemical (i.e., electromotive) series potential differences between the different metals at the contacting surfaces; for example, the mounting plate and bolt extending through it are typically steel, while the vault base is cast iron or Zamac.

It is, accordingly, an object of the present invention to provide a new and improved parking meter having a structure for reducing the effects of corrosion, particularly in environments where the parking meter is subjected to salt water laden air.

SUMMARY OF THE INVENTION

In accordance with the present invention, a parking meter includes a metal structure electrically and mechanically connected to a region of the meter where corrosion tends to occur. The metal structure is also inserted into the earth in the vicinity of the parking meter. The region is where first and second parts have contacting metal surfaces such that corrosion tends to occur at and in the vicinity of the region in response to electrolysis induced electric current having a tendency to flow between the contacting metal surfaces. The metal structure shunts to the earth the current having a tendency to flow between the contacting metal surfaces.

In the preferred embodiment, the parking meter first part is the vault for receiving tokens or credit or debit cards, and the second part is the mounting plate.

The metal structure includes (1) a metal rod extending through the pole and the concrete structure into the ground, (2) a second metal mounting plate at the region, and (3) a metal wire mechanically and electrically connected between the second mounting plate and the metal rod so it extends between legs of the spider. The metal rod, wire and second mounting plate are preferably made of the same high electric conductivity metal, e.g., aluminum, to provide a high conductance electric shunt between the region where corrosion tends to occur and the earth. Because the metal rod, wire and second mounting plate are preferably made of the same metal, electrolysis does not tend to occur between the intersecting surfaces thereof. The second mounting plate is preferably secured in place by the spider attachment bolt, the mounting plate and the interior face of the vault base.

The above and still further objects, features and advantages of the present invention will become apparent upon consideration of the following detailed descriptions of a specific embodiment thereof, especially when taken in conjunction with the accompanying drawings.

BRIEF DESCRIPTION OF THE DRAWINGS

FIG. 4 is a sectional view of the structure illustrated in FIG. 3 in combination with the entire pole and a grounding rod;

FIG. 5 is a top sectional view of the vault, with the vault door removed, in combination with the bolt, first and second mounting plates and wire, as taken through the lines 5—5, FIG. 3; and FIG. 6 is a sectional view of the pole, in combination with the spider, wire, bolt and vault, with the door removed, as taken through the lines 6—6, FIG. 3.

DESCRIPTION OF THE PREFERRED EMBODIMENT

Figure 1:
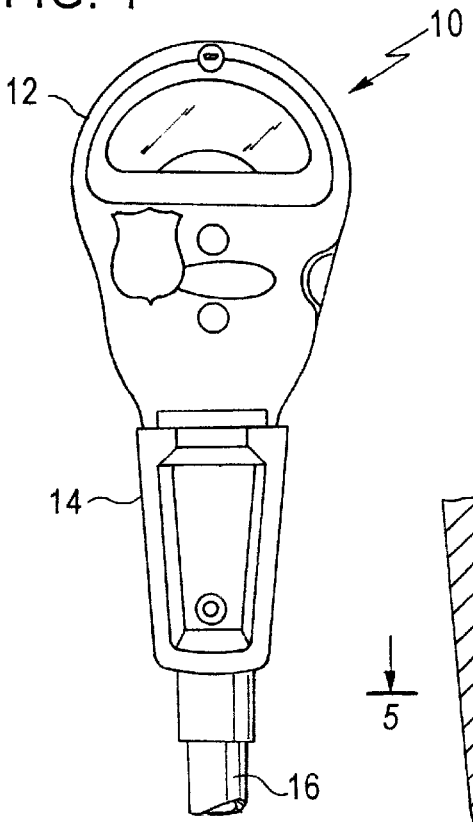
FIG. 1 is a view of the top portion of a typical parking meter including a preferred embodiment of a corrosion reducing grounding structure of the present invention.
Figure 3:
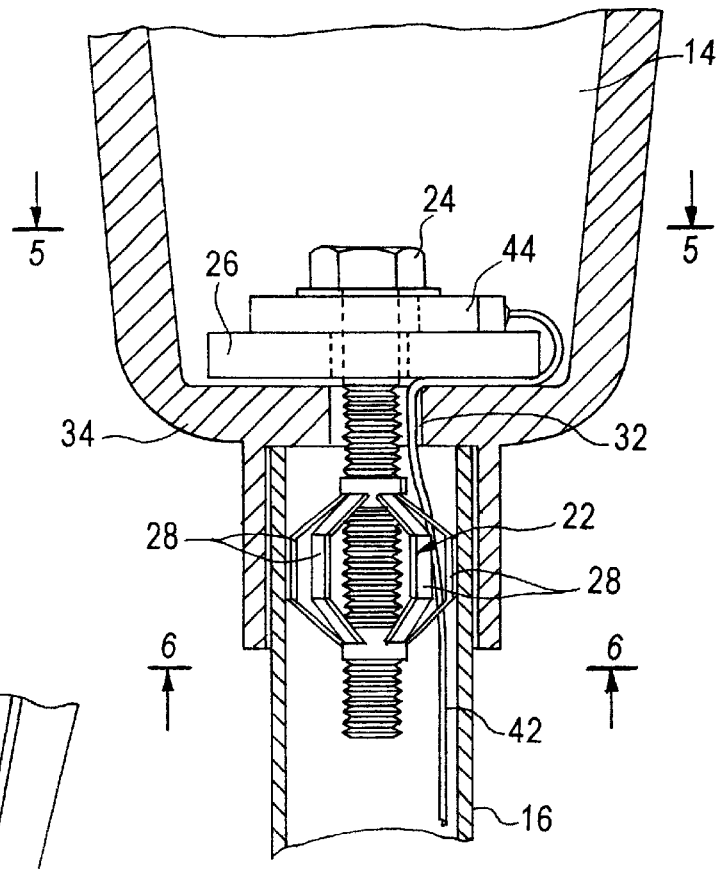
FIG. 3 is a sectional view of the lower portion of the vault illustrated in FIG. 2, in combination with a meter pole, a spider, a first mounting plate, a second mounting plate, a bolt and a wire connected to the second mounting plate.
Figure 2:
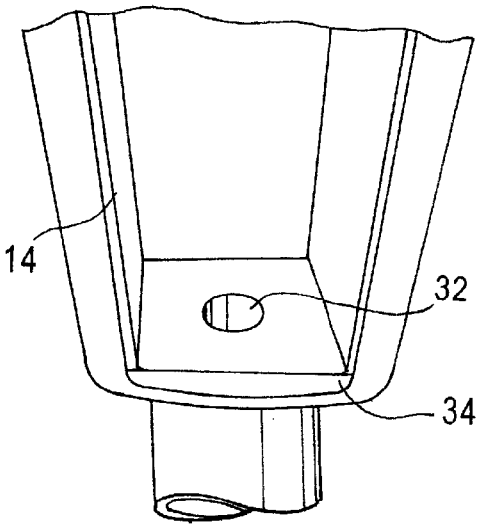
FIG. 2 is a side view of the lower portion of a meter housing vault, with the vault door removed.

Reference is now made to the drawing wherein parking meter 10 is illustrated as including meter head 12, fixedly mounted by conventional means (not shown) on vault 14, in turn mounted on hollow pole 16, the lower end of which is secured to the earth 18 by being embedded and captured in concrete structure 20 that is shown as sidewalk, but can be a footing in the ground. Head 12 and vault 14 are typically made of cast iron or cast Zamac, an alloy of zinc and aluminum. If head 12 and vault 14 are made of cast iron, the cast iron is preferably covered by a hot dip galvanized coating, in turn covered by a none-poxy thermosetting electrically insulating organic powder coating, as disclosed in my previously mentioned co-pending application. Pole 16 is usually made of steel having galvanized coatings covering its exterior surfaces.

Vault 14 is fixedly mounted to the top of pole 16 by steel spider 22, threaded steel bolt 24 and steel mounting plate 26. Spider 22 includes five legs 28 radially extending from central barrel 30 including a threaded bore. In use, the ends of legs 28 remote from barrel 30 engage the interior wall of hollow pole 16 in response to the threads of bolt 24 being screwed on the threads of the bore of barrel 30. Bolt 24 extends through non-threaded opening 32 in base 34 of vault 14. Mounting plate 26 has a lower face abutting an upper face of vault base 34 and a threaded central bore engaged by the threads of bolt 24.

The description of parking meter 10 up to this point is of a conventional parking meter, except for the coatings on head 12 and vault 14. A problem with the described parking meter is that corrosion of head 12, vault 14 and pole 16 has a tendency to occur, particularly when the parking meter is in air laden by salt water. I have determined that the reason for the corrosion is an electrolytic action which begins at the contacting surfaces, i.e., interface of mounting plate 26 and base 34 of vault 14. The electrolytic action causes DC current to flow between mounting plate 26 and vault base 34. The DC current attacks the metal in vault 34 to initiate the corrosive effects at the interface. The corrosive effects spread from the interface to other portions of vault 14, to head 12 and to pole 16. The electrolytic action, which appears to be initiated by ions in the salt water laden air, seems to be augmented by the differences in the electrochemical series potential differences of steel mounting plate 26 and cast iron base 34 of vault 14.

In accordance with the present invention, the DC current which flows in response to the electrolytic action at the interface between mounting plate 26 and base 32 is shunted to ground 18 by an electrically conducting structure having considerably higher conductivity to ground than the remainder of the parking meter. The remainder of the parking meter has a relatively low electrical conductivity, i.e., high electrical impedance path, to ground 18 because the steel and cast iron metal parts have relatively low electrical conductivity and because concrete slab 20 is an electrical insulator. In addition, the galvanized coatings on all surfaces of pole 16 are relatively poor electrical conductors.

The high conductivity, electrically conducting structure for shunting current at the interface between mounting plate 26 and base 34 of vault 14 includes solid aluminum grounding rod 40, aluminum wire 42 and aluminum mounting plate 44. The upper portion of rod 40 extends through the lower portion of pole 16 below spider 22, while the lower portion of rod 40 extends through concrete slab 20 and is buried between one-third and two-thirds of a meter in ground 18. Aluminum wire 42, preferably braided and having a relatively large diameter of about 0.5 cm., has a first end electrically and mechanically fixed to an upper portion of rod 40. A central portion of wire 42 extends between adjacent arms of spider 22 and through hole 32 in base 34 of vault 14. The upper part of wire 42 extends into the interior of vault 14 and has a second end electrically and mechanically secured to mounting plate 44. The ends of wire 42 are fixedly secured to pole 16 and aluminum mounting plate 44 by welding or soldering. Alternatively, wire 42 and rod 40 can be secured to each other by an aluminum screw or the wire can be wound around the grounding rod, or plate 44 can include an eyelet through which the second end of wire 42 is threaded and held in situ by an aluminum screw. The metal interior portion of wire 42 is encased in electric insulating sheath 43 (FIG. 6) which prevents electric contact between the metal portion of the wire and each of spider legs 28, the walls of bore 32, base 34 and mounting plate 26 to assure that the current in mounting plate 28 flows to ground via rod 40 and is not diverted to other parts of meter 10. Sheath 43 also mechanically protects the metal part of wire 42, to prevent fraying of the metal part.

Aluminum mounting plate 44 fits around the threaded shaft of spider attachment bolt 24 and is sandwiched in place between the top face of mounting bolt 26 and the bottom face of the head of bolt 24. To these ends, aluminum plate 44 is preferably shaped as a horseshoe, i.e., has a U-shape, including parallel arms 46 and 48 that extend from shoulder 50 to form an open end to facilitate insertion of the mounting plate on the shaft of bolt 24 between the bolt head bottom face and the top face of steel mounting plate 26. The upper end of wire 42 is connected to the center of shoulder 50. Arms 46 and 48 extend around the shaft of spider attachment bolt 24. Arms 46 and 48 and shoulder 50 of plate 26 have flat top and bottom surfaces that are parallel to each other, to engage corresponding flat and parallel surfaces at the top of mounting plate 26 and the bottom of the head of spider attaching bolt 24.

As a result of the previously described electrolysis process which occurs between mounting plate 26 and base 34 of vault 14, DC current has a tendency to flow between the mounting plate and base of the vault. The current, over time, causes substantial oxidation, i.e., rust, of the base of vault 14. The high conductivity current path provided to ground 18 by relatively massive aluminum plate 44, which is essentially at the site of the initial corrosive action, aluminum wire 42 and aluminum grounding rod 40 shunts the current flowing between mounting plate 26 and vault 14 to ground, whereby, the current resulting from the electrolysis process does not substantially attack vault 14 and vault 14 remains relatively free of corrosion. Because vault 14 remains relatively free of corrosion, meter head 12 and meter pole 16 also remain free of corrosion.

While there have been described and illustrated a specific embodiment of the invention, it will be clear that variations in the details of the embodiment specifically illustrated and described may be made without departing from the true spirit and scope of the invention as defined in the appended claims. For example, the positions of steel mounting plate 26 and aluminum plate 44 can be reversed such that plate 44 is positioned between base 34 of vault 14 and the mounting plate and the mounting plate abuts the lower face of the head of spider attachment bolt 24. Further, aluminum mounting plate 44 need not have the horseshoe shape, but can include a central opening completely surrounded by the remainder of the plate. Also, rod 40, wire 42 and rod 44, which are described as being made of aluminum, can be made of copper or other metals having conductivities comparable to or higher than aluminum.

What is claimed is:

1. A parking meter including first and second parts having contacting metal surfaces such that corrosion tends to occur in a region at and in the vicinity of the contacting metal surfaces in response to electrolysis induced electric current having a tendency to flow between the contacting metal surfaces, a metal structure electrically and mechanically connected to the region for insertion into the earth in the vicinity of the parking meter and for shunting to the earth the current having a tendency to flow between the contacting metal surfaces.

2. The meter of claim 1 wherein the region is in the interior of the parking meter and the parking meter is mounted by a hollow pole to a concrete structure in the ground, a portion of the metal structure extending through the pole from the ground to the region.

3. The meter of claim 2 wherein a spider for holding the meter in place on the pole is in the interior of the pole and the metal structure includes (a) a metal wire extending through the spider and (b) a metal rod electrically and mechanically connected between the metal wire and the earth.

4. The meter of claim 3 wherein the parking meter first part is a vault for receiving tokens or credit or debit cards, and the second part is a first mounting plate inside the vault, a spider attachment bolt passing through openings in a base of the vault and the mounting plate and threaded to the spider and the first mounting plate, the metal structure including a second mounting plate at the region, the second mounting plate being secured in place by the spider attachment bolt, the mounting plate and the vault base; the second mounting plate and the wire being electrically and mechanically connected.

5. The meter of claim 4 wherein the contacting surfaces are of different metals.

6. The meter of claim 4 wherein the second mounting plate, metal rod and wire are all made of the same metal having an electric conductivity substantially greater than the electric conductivity of the pole.

7. The meter of claim 6 wherein the metal is aluminum or copper.

8. The meter of claim 2 wherein the metal wire includes an interior metal portion surrounded by an electric insulator preventing electric contact between the metal portion, the metal surfaces and the spider.

9. The meter of claim 8 wherein the electric insulator includes a sheath surrounding the metal portion.

10. The meter of claim 1 wherein the parking meter first part is a vault for receiving tokens or credit or debit cards, and the second part is a first mounting plate inside the vault, a spider attachment bolt passing through openings in a base of the vault and the first mounting plate and threaded to the first mounting plate and a spider in the interior of a hollow pole mounting the vault to a concrete structure, the spider and first mounting plate securing the vault to the hollow pole, the metal structure including a second mounting plate at the region, the second mounting plate being secured in place by the spider attachment bolt, the mounting plate and the vault base; the second mounting plate and the wire being electrically and mechanically connected.

11. The meter of claim 10 wherein the spider, the metal structure including a second mounting plate at the region, the second mounting plate being secured in place by the spider attachment bolt, the mounting plate and the vault base; the second mounting plate and the wire being electrically and mechanically connected.

12. The meter of claim 11 wherein the contacting surfaces are of different metals.

13. The meter of claim 10 wherein the contacting surfaces are of different metals.

14. The meter of claim 10 wherein the second mounting plate, metal rod and wire are all made of the same metal having an electric conductivity substantially greater than the electric conductivity of the pole.

* * * * *